United States Patent [19]

Momoshima et al.

[11] Patent Number: 4,497,235

[45] Date of Patent: Feb. 5, 1985

[54] ELECTRONIC MUSICAL INSTRUMENT

[75] Inventors: Yukichi Momoshima; Nobuyuki Nagasaka; Mamoru Mine, all of Tokyo, Japan

[73] Assignee: Kabushiki Kaisha Daini Seikosha, Tokyo, Japan

[21] Appl. No.: 463,138

[22] Filed: Feb. 2, 1983

[30] Foreign Application Priority Data

Feb. 9, 1982 [JP] Japan ..... 57-19444

[51] Int. Cl.[3] ..... G10H 1/02

[52] U.S. Cl. ..... 84/1.19; 84/1.24; 84/1.01

[58] Field of Search ..... 84/1.19, 1.24, 1.17, 84/DIG. 22, DIG. 4, 1.01, 1.03, 1.25

[56] References Cited

U.S. PATENT DOCUMENTS

| | | | |
|---|---|---|---|
| 4,080,862 | 3/1978 | Hiyoshi et al. | 84/1.24 |
| 4,083,283 | 4/1978 | Hiyoshi et al. | 84/1.24 |
| 4,160,404 | 7/1979 | Yamada et al. | 84/1.24 |
| 4,166,405 | 9/1979 | Hiyoshi et al. | 84/1.24 |
| 4,208,939 | 6/1980 | Wangard et al. | 84/1.17 |
| 4,348,932 | 9/1982 | Kasido | 84/1.19 |
| 4,354,415 | 10/1982 | Sonnabend | 84/1.24 |
| 4,391,176 | 7/1983 | Minomi et al. | 84/1.17 |
| 4,423,655 | 1/1984 | Turner | 84/1.19 |
| 4,450,745 | 5/1984 | Nakada et al. | 84/1.19 |

*Primary Examiner*—Forester W. Isen

*Attorney, Agent, or Firm*—Robert E. Burns; Emmanuel J. Lobato; Bruce L. Adams

[57] ABSTRACT

An electronic musical instrument in which a plurality of musical waveforms are obtained by a time-sharing style of multi-channels according to key data input from a keyboard. A wave-shape memory memorizes a plurality of wave-shape data representative of basic one cycle waveforms of different musical wave shapes. A musical instrument selecting circuit designates the a kind of wave-shape for each of the channels which is to be read out from the wave-shape memory, and a sound effect selecting circuit designates the kind of effect of each of the channels. A pitch forming circuit generates pitch data for reading of the wave-shape memory in each of the channels according to the key data and output data from the sound effect selecting circuit.

8 Claims, 1 Drawing Figure

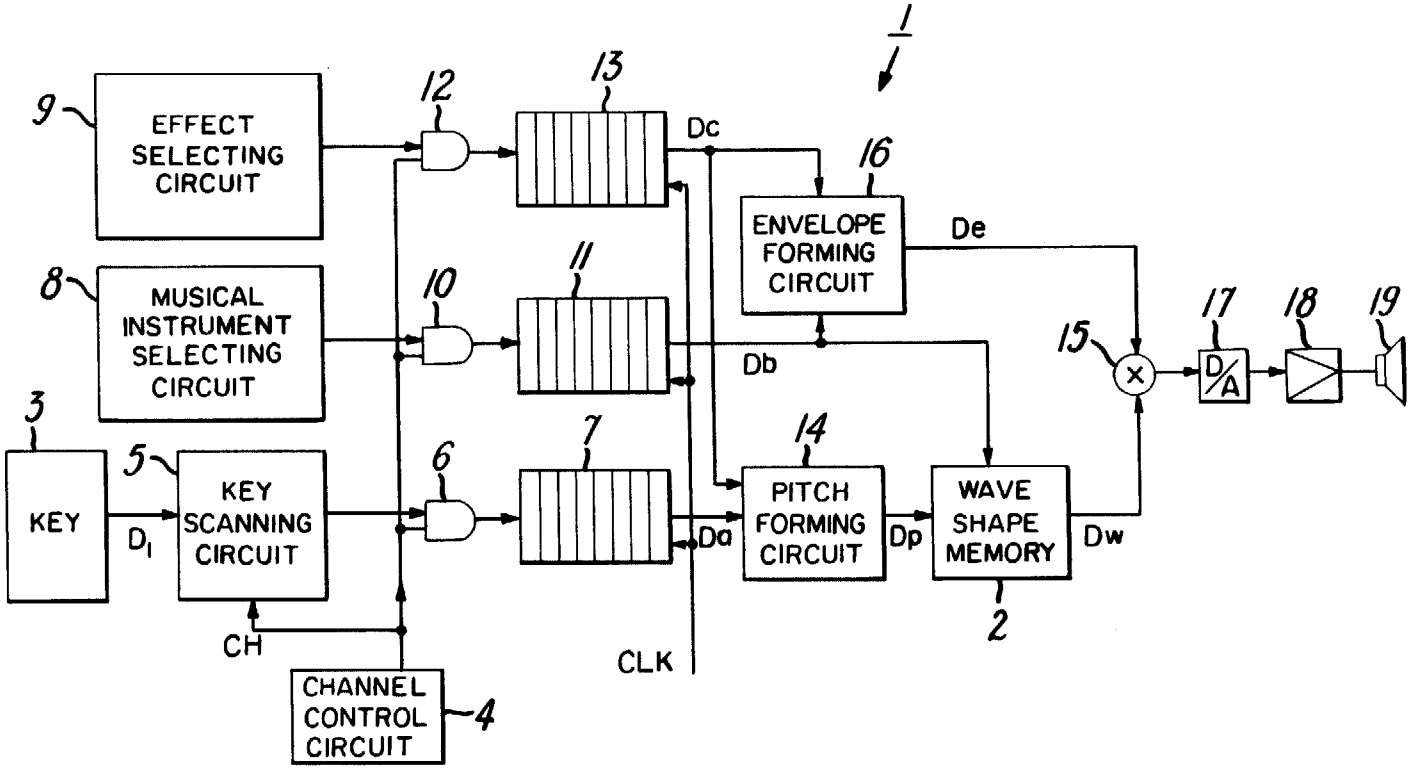
1
EFFECT SELECTING CIRCUIT
9
MUSICAL INSTRUMENT SELECTING CIRCUIT
8
KEY
3
$D_I$
KEY SCANNING CIRCUIT
5
CH
CHANNEL CONTROL CIRCUIT
4
12
10
6
13
11
7
Dc
Db
Da
CLK
ENVELOPE FORMING CIRCUIT
16
De
PITCH FORMING CIRCUIT
14
Dp
WAVE SHAPE MEMORY
2
Dw
15
D/A
17
18
19

ELECTRONIC MUSICAL INSTRUMENT

BACKGROUND OF THE INVENTION

The present invention relates generally to an electronic musical instrument, and more particularly, to an electronic musical instrument capable of simultaneously playing many musical sounds composed of different tone colors, music tones and effects.

In the conventional musical instrument, the tone color and effect applied from a keyboard according to a musical sound data are the same, however, it is not possible to produce a plurality of musical sounds which have only different musical tones respectively. Therefore, if a plurality of sounds are simultaneously generated, the music tone is the same and the music sound is a simple one.

The object of the present invention is to provide an improved electronic musical instrument which can simultaneously generate a plurality of musical sounds composed of different tone colors, musical tones and effects.

BRIEF DESCRIPTION OF THE DRAWINGS

The drawing shows a circuit diagram of one embodiment of the electronic musical instrument according to the present invention.

The drawing shows a block diagram of a preferred embodiment of the present invention. An electronic instrument 1 has a wave shape memory 2 which stores musical sound wave-shape data of the basic one cycle waveforms for a plurality of musical instruments so that a wave shape data forming process based on a plurality of music tone data selected by a keyboard 3 is processed by an eight-channel time-sharing process. The desired key data signal $D_1$ from said keyboard 3 is obtained from a key scanning circuit 5 in which a channel signal CH from a channel controlling circuit 4 is applied thereto, and the maximum eight key data is applied to an eight-channel shift register 7 through AND-circuit 6 by time-slots which correspond to the eight channels.

The electronic musical instrument 1 has a musical instrument selecting circuit 8 for designating a particular musical instrument sound for each of the channels and an effect selecting circuit 9 for designating the desired kind of effect for each of the channels. The musical instrument selecting circuit 8 is able to generate a musical instrument selecting data signal $D_2$ for selecting a preferred wave-shape corresponding to piano, organ, guitar, etc. which are memorized in said wave-shape memory 2, and the musical instrument selecting data signal $D_2$ is stored in an eight-channel shift register 11 through AND-circuit 10 which is controlled by the channel signal CH. The shift register 11 executes a data-shift operation synchronized with the shift register 7 whereby it is able to store a preferred musical instrument selecting data signal by time-slots which correspond to the channels.

The effect selecting circuit 9 is operable to generate an effect selecting data signal $D_3$ for selecting one effect from the various effects such as vibrato, tremolo and so on, and the effect selecting data signal $D_3$ is stored in an eight-channel shift register 13 through AND-circuit 12 which is controlled by the channel signal CH. The shift register 13 executes a data-shift operation synchronized with the shift register 7 whereby it is able to store a preferred effect selecting data signal by time-slots which corresponds to the preferred channel.

Therefore, a data which can designate a musical instrument corresponding to eight channels is stored in the shift-register 11, and a data which can designate an effect corresponding to eight channels is stored in the shift resister 13. A clock pulse CLK is applied to the shift registers 7, 11 and 13 so that each of the data corresponding to each channel are obtained from the time-slots by the clock pulse CLK.

A key data signal Da and effect data signal Dc generated from the shift registers 7 and 13 are applied to a pitch forming circuit 14 whereby a reading pitch data signal Dp of the wave-shape memory 2 is formed by the data. A musical sound data signal Db from the shift register 11 is applied to the wave-shape memory 2 whereby a preferred wave-shape (for example, a basic wave-shape representative of a piano sound) in basic wave-shape data which is stored in the wave-shape memory 2 is selected by the musical sound data signal Db and the wave-shape memory 2 produces a corresponding musical sound wave-shape data signal Dw. Therefore, a musical sound of different musical tones in all of the channels is generated from the wave-shape memory 2 by means of a time-sharing process as different tone colors and effects which differ from each other and are applied to an operating circuit 15.

The musical sound data signal Db and the effect data signal Dc from the shift registers 11 and 13 are applied to an envelope forming circuit 16 which produces an envelope data signal De according to the data signals Db and Dc and applies the same to the operating circuit 15. The operating circuit 15 programs the envelope data signal De and the musical sound wave-shape data signal Dw from the wave-shape memory 2 thereby enveloping each musical sound wave-shape data signal Dw for eight channels. An operated output signal from said operating circuit 15 is changed to an analogue wave-shape signal by a D/A converter 17. The analogue wave-shape signal is amplified by an amplifier 18 and converted to musical sound from a speaker 19.

According to the present invention, it is possible to generate independently different tone color, musical tone and effect in each of the channels, whereby it is possible to improve a simple musical note which was insufficient in the conventional type.

Further, it is possible to select a number of channels inspite of utilizing the eight-channel time-sharing process.

We claim:

1. An electronic musical instrument comprising in combination: a plurality of keys connected to a key scanning circuit; a musical instrument selecting circuit for selecting different musical instrument sounds; an effect sound selecting circuit for selecting different sound effects; a channel control circuit connected to said key scanning circuit; a first AND-gate connected to receive an output signal of said effect sound selecting circuit and an output signal of said channel controlling circuit; a second AND-gate connected to receive an output signal of said musical instrument selecting circuit and an output of said channel control circuit; a first shift register having a plurality of channels and being connected to said first AND-gate; a second shift register having a plurality of channels and being connected to said second AND-gate; a third shift register having a plurality of channels and being connected to said third AND-gate; means for applying a clock signal to said first, second and third shift registers to synchronously actuate the channels of said first, second and third shift registers; an envelope forming circuit connected to receive the output signals of said first and second shift registers; a pitch forming circuit connected to receive the output signals of said first and third shift registers; a wave shape memory connected to receive the output signals of said second shift register and said pitch forming circuit; an operating circuit responsive to the output signals of said envelope forming circuit and said wave shape memory for enveloping the wave shape data of the output signal of said wave shape memory; a D/A converter for converting an output signal of said operating circuit to an analogue signal; and an amplifier and speaker for generating a sound from the analogue signal of said D/A converter.

2. In an electronic musical instrument having a keyboard for inputting key data: first selecting means for selecting a plurality from among a group of different musical instrument sounds representative of different musical instruments and producing a plurality of corresponding musical instrument sound data signals; second selecting means for selecting a plurality from among a group of different musical sound effects and producing a plurality of corresponding musical sound effects data signals; first shift register means having a plurality of channels and being operative when actuated to data-shift on different channels the musical instrument sound data signals selected by the first selecting means; second shift register means having a plurality of channels and being operative when actuated to data-shift on different channels the musical sound effects data signals selected by the second selecting means; means for synchronously actuating the first and second shift register means to effect data-shifting of the respective data signals in synchronism; and circuit means receptive of the synchronously data-shifted data signals output from the first and second shift register means for producing therefrom a plurality of different musical sound data signals each corresponding to one of the different channels and each differing from the others in musical instrument sound and musical sound effects.

3. An electronic musical instrument according to claim 2; wherein the circuit means comprises an envelope forming circuit connected to receive the synchronously data-shifted data signals output from the first and second shift register means for producing a plurality of different envelope data signals each corresponding to one of the different channels, a wave shape memory for storing wave-shape data representative of waveforms of a plurality of different musical instruments and connected to receive the synchronously data-shifted data signals output from the first shift register means for producing a plurality of different musical sound wave-shape data signals each corresponding to one of the different channels, and an operating circuit receptive of the envelope data signals and the sound wave-shape data signals for combining the same and producing the plurality of different musical sound data signals.

4. An electronic musical instrument according to claim 3; wherein the circuit means further comprises a key scanning circuit connected to scan and receive the key data from the keyboard and produce corresponding key data signals, third shift register means having a plurality of channels and being actuated in synchronism with the first and second shift register means to data-shift on different channels the key data signals output from the key scanning circuit, and a pitch forming circuit connected to receive the synchronously data-shifted data signals from the second and third shift register means for producing a plurality of reading pitch data signals and applying the same to the wave shape memory.

5. An electronic musical instrument according to claim 4; wherein the first, second and third shift register means all have the same predetermined number of channels which is at least four.

6. An electronic musical instrument according to claim 5; wherein the predetermined number of channels is eight.

7. An electronic musical instrument according to claim 2; wherein the first and second shift register means both have the same predetermined number of channels which is at least four.

8. An electronic musical instrument according to claim 7; wherein the predetermined number of channels is eight.

* * * * *